US005358035A

United States Patent [19]

Grudzinski

[11] Patent Number: 5,358,035

[45] Date of Patent: Oct. 25, 1994

[54] CONTROL CARTRIDGE FOR CONTROLLING A SAFETY VALVE IN AN OPERATING WELL

[75] Inventor: Richard Grudzinski, Vineuil St. Firmin, France

[73] Assignee: GEO Research, Roissy-Charles-de-Gauelle, France

[21] Appl. No.: 117,536

[22] Filed: Sep. 7, 1993

[30] Foreign Application Priority Data

Sep. 7, 1992 [FR] France ..... 92 10647

[51] Int. Cl.[5] ..... E21B 34/06; E21B 44/00

[52] U.S. Cl. ..... 166/53; 166/66.4; 166/332; 166/373; 166/317; 340/854.8; 340/856.4

[58] Field of Search ..... 166/53, 66.4, 332, 386, 166/317, 373, 374; 251/62, 63, 129.15, 129.22; 340/853.3, 854.8, 856.3, 856.4

[56] References Cited

U.S. PATENT DOCUMENTS

| | | | |
|---|---|---|---|
| 4,062,379 | 12/1977 | Clinton | 166/53 X |
| 4,082,147 | 4/1978 | Wolff et al. | 166/53 X |
| 4,161,215 | 7/1979 | Bourne, Jr. et al. | 166/53 X |
| 4,736,791 | 4/1988 | Rorden et al. | 166/66.4 |
| 4,796,699 | 1/1989 | Upchurch | 166/53 X |
| 4,796,708 | 1/1989 | Lembcke | 166/386 |
| 4,856,595 | 8/1989 | Upchurch | 166/53 X |
| 4,915,168 | 4/1990 | Upchurch | 166/53 X |

FOREIGN PATENT DOCUMENTS

| | | |
|---|---|---|
| 3510546 | 10/1986 | Fed. Rep. of Germany . |
| 2048344A | 12/1980 | United Kingdom . |
| 2106162A | 4/1983 | United Kingdom . |

*Primary Examiner*—Stephen J. Novosad
*Attorney, Agent, or Firm*—Wenderoth, Lind & Ponack

[57] ABSTRACT

An operating well such as an oil well is provided with a safety valve in the tubing thereof. A control cartridge controls the safety valve under the command of control signals transmitted from the surface. The control cartridge includes a housing mounted in the tubing and a receiver for receiving signals transmitted from the surface. A power supply is provided in the housing and is connected to an electronic control system, which control system is also connected to the receiver. A hydraulically operated actuator controls the safety valve, and a source of hydraulic fluid is provided in the housing and connected with the hydraulically operated actuator for operating the actuator. The source of hydraulic fluid is also connected to the power supply for operation thereof.

30 Claims, 3 Drawing Sheets

5
7
2
8
4
6
9
22
10
11
12
13
26
17
14
16
15
18
19
20
21

CONTROL CARTRIDGE FOR CONTROLLING A SAFETY VALVE IN AN OPERATING WELL

BACKGROUND OF THE INVENTION

The present invention relates to a cartridge that is designed to be mounted in the tubing of an operating well, for example an oil well, in order to control the opening and closing of a safety valve located at a certain depth in the tubing and through which a fluid such as oil being drilled can flow.

A first object of the present invention is to provide for the automatic and rapid closing of a safety valve. It is a further object of the invention to provide for the automatic and rapid closing of a safety valve such as a gate valve, also referred to as a flapper valve, or, for that matter, any other type of valve used in oil wells, such as spherical plug valves.

It is a second object of the present invention to enable the voluntary closing of a valve located at a relatively significant depth in well tubing from either ground level or from an ocean platform, either with or without an access code as desired.

It is a further object of the present invention to provide for either voluntary rapid closing, or automatic closing, of a safety valve in a drilling well, in particular during oil drilling operations. Such automatic or voluntary closing of the safety valve may be good for safety reasons as well as for preventing pollution of the environment, for example by preventing oil from being spilled into the marine environment from an off-shore oil drilling platform.

SUMMARY OF THE INVENTION

The above-discussed objects of the present invention are achieved in accordance with the present invention by the provision of a control cartridge which controls the closing of a safety valve mounted in the tubing of an operating well.

The control cartridge according to the present invention has a cartridge housing mounted in the tubing. A receiver, further, is provided for receiving transmitted control signals from a remote location, such as from ground level or an ocean platform. A power supply is further provided in the housing, and an electronic control system in the housing is connected to both the receiver and the power supply. The safety valve is controlled by a hydraulically operated actuator. There is thus further provided a source of hydraulic fluid in the housing connected with the hydraulically operated actuator for operating the actuator. The source of hydraulic fluid is further connected to the power supply.

Preferably, the actuator includes a high-pressure hydraulic fluid tank that has a piston rod extending therefrom to the exterior of the housing. The piston rod then operably engages the safety valve.

Further, the source of hydraulic fluid includes a low-pressure hydraulic fluid tank that is defined in the housing. A hydraulic pump is immersed in this low pressure tank for receiving low-pressure hydraulic fluid therefrom, and has a discharge pipe that connects the pump to the high-pressure hydraulic fluid tank of the actuator. A motor is connected to the power supply and to the hydraulic pump for driving the hydraulic pump. The high-pressure hydraulic fluid tank is also immersed in the low-pressure hydraulic fluid tank.

Further, the high-pressure hydraulic fluid tank preferably has a fluid connection connecting it to the low-pressure fluid tank as well as an electronically controlled valve in the fluid connection that is controlled by the electronic control system. The fluid connection, further, preferably includes a connection pipe having a free end that defines a valve seat. The electronically controlled valve includes a sealing member for sealing against the valve seat, a spring for biasing the sealing member against the valve seat and an electromagnet having a coil forming a solenoid and a ferromagnetic core rod engaging the spring for biasing the sealing member against the valve seat when the electromagnet is provided with a current.

According to a further preferred feature of the present invention, the electronic control system includes a control card capable of reading coded signals from the receiver and supplying current from the power supply to the electromagnet in response to the coded signals.

A position sensor, further, is provided for sensing the position of the actuator. The position sensor is connected with the electronic control system so that the position sensor and the electronic control system together define a means for stopping advance of the actuator when the actuator has advanced to a predetermined position. Further, the electronic control system and the position sensor further define a means for automatically compensating for leaks of hydraulic fluid from the high-pressure hydraulic fluid tank by causing the source of hydraulic fluid to supply more hydraulic fluid upon the actuator retracting beyond a threshold amount from its extended position.

In one form of the receiver, the receiver includes an antenna that is positioned inside the tubing. In this form of the receiver, the receiver is an electromagnetic signal receiver capable of receiving electromagnetic signals transmitted through the ground.

However, the receiver could also be a pressure sensor mounted on the tubing capable of receiving acoustic signals propagated through fluid in the tubing. Alternatively, the receiver could include a pressure sensor that is mounted on an upper portion of the housing of the control cartridge, similarly capable of receiving acoustic signals propagated through fluid in the tubing.

BRIEF DESCRIPTION OF THE DRAWINGS

Further features and advantages of the present invention will become apparent from the following detailed description of preferred embodiments of the invention with reference to the accompanying drawings figures, wherein.

DETAILED DESCRIPTION OF THE PREFERRED EMBODIMENTS

Figure 1:
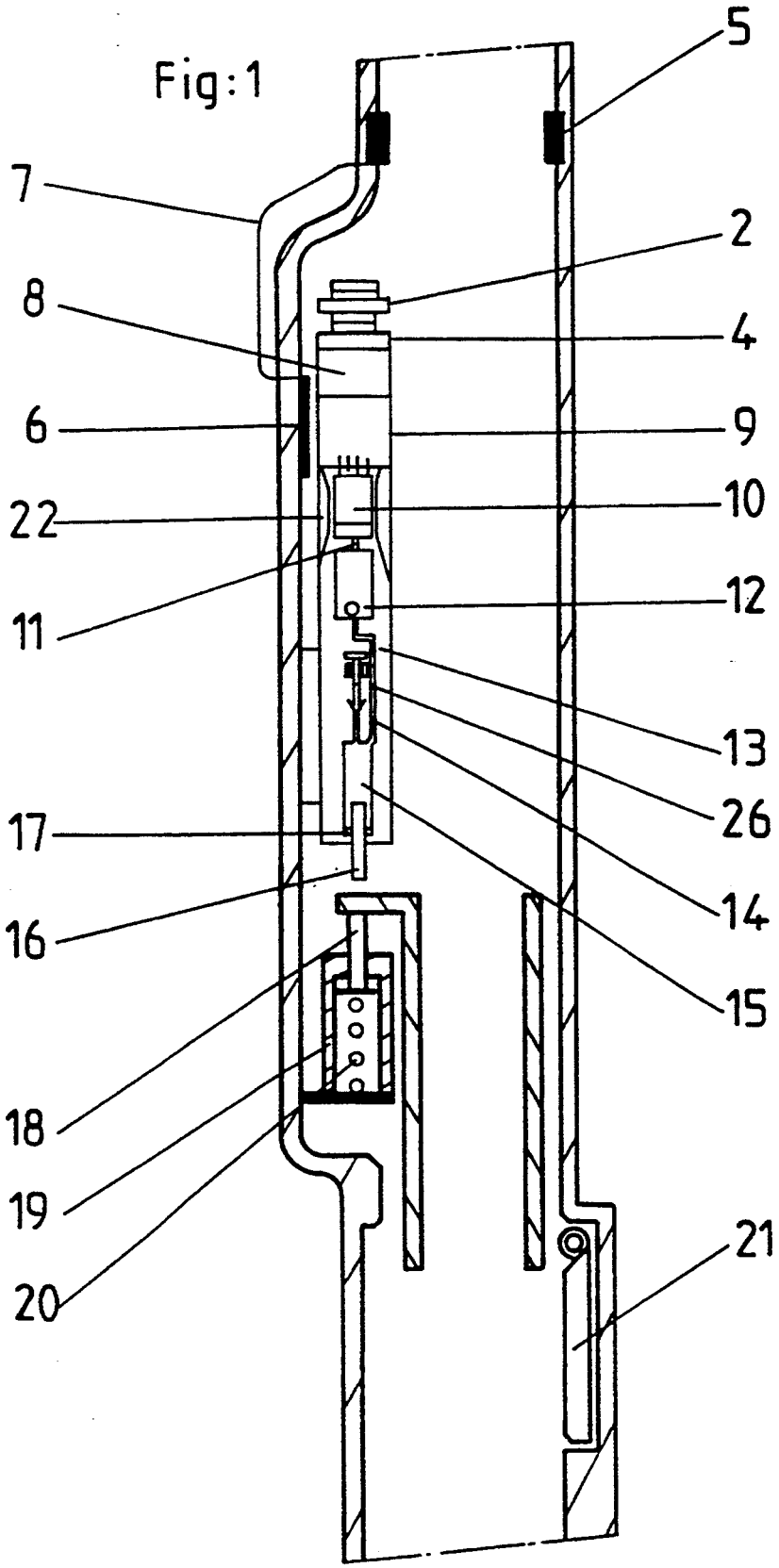
FIG. 1 is a schematic and partial cross-sectional view of a control cartridge according to the present invention as provided in tubing of an operating well.

Referring initially to FIG. 1, there can be seen an elongated control cartridge 1 in accordance with the present invention mounted in the tubing of an operating well such as an oil well. The elongated control cartridge is designed to be inserted into the tubing and attached beneath a packer in the tubing (not shown).

Initially, the elongated cartridge includes an assembly mandrel 2 connected with a housing 3 of the control cartridge.

The control cartridge 1 further includes an electromagnetic receiver generally designated by reference numeral 4. The receiver 4 includes, in the embodiment of FIG. 1, an antenna 5 that is positioned inside the tubing for receiving electromagnetic signals transmitted from the surface, a magnetic coupler 6 and cables or wires 7 connecting the magnetic coupler 6 to the antenna 5. The magnetic coupler 6 makes it possible to connect, without contact, the antenna 5 to the control cartridge 1. Note FIG. 2, wherein the arrangement of the magnetic coupler is more particularly illustrated.

The control cartridge 1 further includes a power supply 8, which preferably comprises a set of batteries, for supplying power to an electronic control system 9, also mounted in the control cartridge 1, and a geared motor 10.

As can be seen from FIG. 1, the geared motor 10, mounted in the control cartridge 1, has an output shaft 11 driving a hydraulic pump 12.

A low-pressure oil tank 13 is defined inside the housing 3 of the control cartridge 1. Note also FIGS. 2 and 3. The hydraulic pump 12 is immersed in the low-pressure oil tank 13 so that the low-pressure oil tank 13 is employed as the source of hydraulic fluid (oil) for the hydraulic pump 12.

The hydraulic pump 12 has a discharge pipe 14 that extends to and is connected with an actuator. The actuator includes a high-pressure tank 15 fluidly connected with the discharge pipe, thus receiving pressurized hydraulic fluid (oil) from the hydraulic pump 12. A piston rod or jack rod 16 extending from the high-pressure tank 15, as illustrated in FIGS. 2 and 3, is thus operated by the supply of pressurized hydraulic fluid to the high-pressure tank 15.

The piston rod 16 has its position controlled by a position sensor 17, schematically illustrated in FIG. 1. As further illustrated in FIG. 1, the piston rod 16 can extend from the control cartridge 1 to engage a frontal element 18 of a cover 19 that encloses a spring 20 associated with a flapper valve 21. The flapper valve 21 is designed so as to seal the tubing in order to halt the flow of the fluid being drilled. Thus, when the piston rod 16 is extended from the control cartridge 1, the flapper valve 21 will be open, and when the piston rod 16 is retracted into the housing as shown in FIG. 3, the flapper valve 21 will be closed.

The position sensor 17, connected to the electronic control system 9, senses the position of the piston rod 16 so as to stop the hydraulic pump 12 when the piston rod 16 reaches the end of its extension stroke. Further, if there is a leak of hydraulic fluid from the high-pressure tank 15, for example, the position sensor 17 can also control the hydraulic pump 12 to restart and supply more hydraulic fluid when the piston rod 16 tends to retract. A threshold value of the amount of retraction can be set. As can be further schematically seen in the drawings, in particular noting FIG. 1, a pressure-compensation diaphragm in the form of a sleeve 22 is provided at the level of the geared motor 10.

Figure 2:
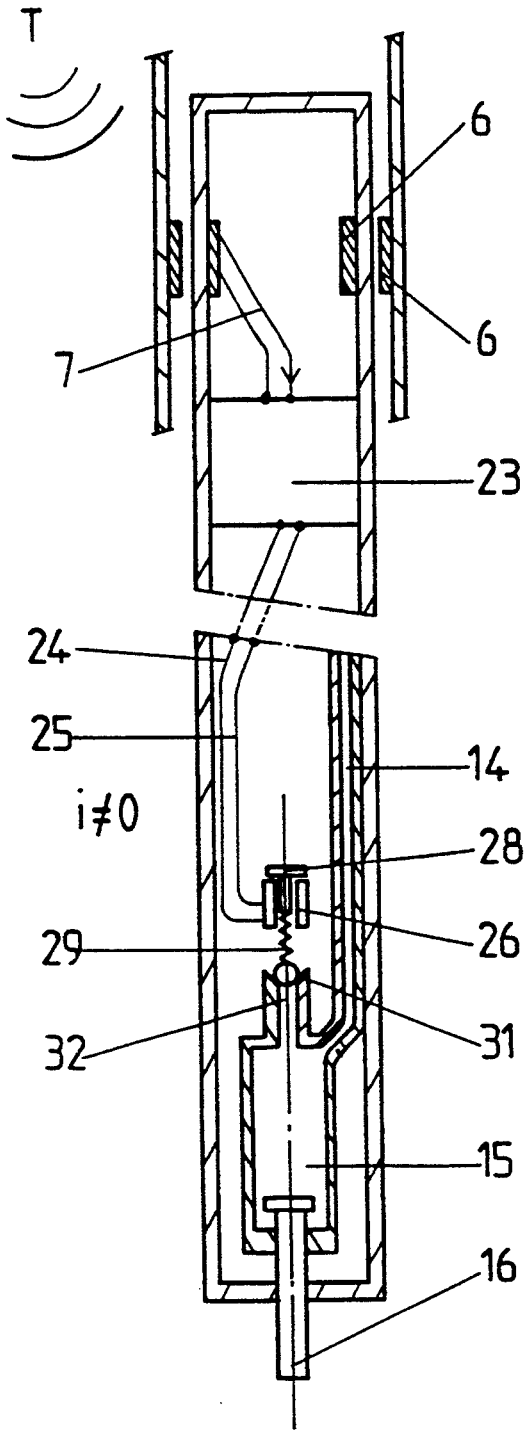
FIG. 2 is a schematic, cross-sectional view of the control cartridge of FIG. 1 corresponding to an open position of a safety valve.
Figure 3:
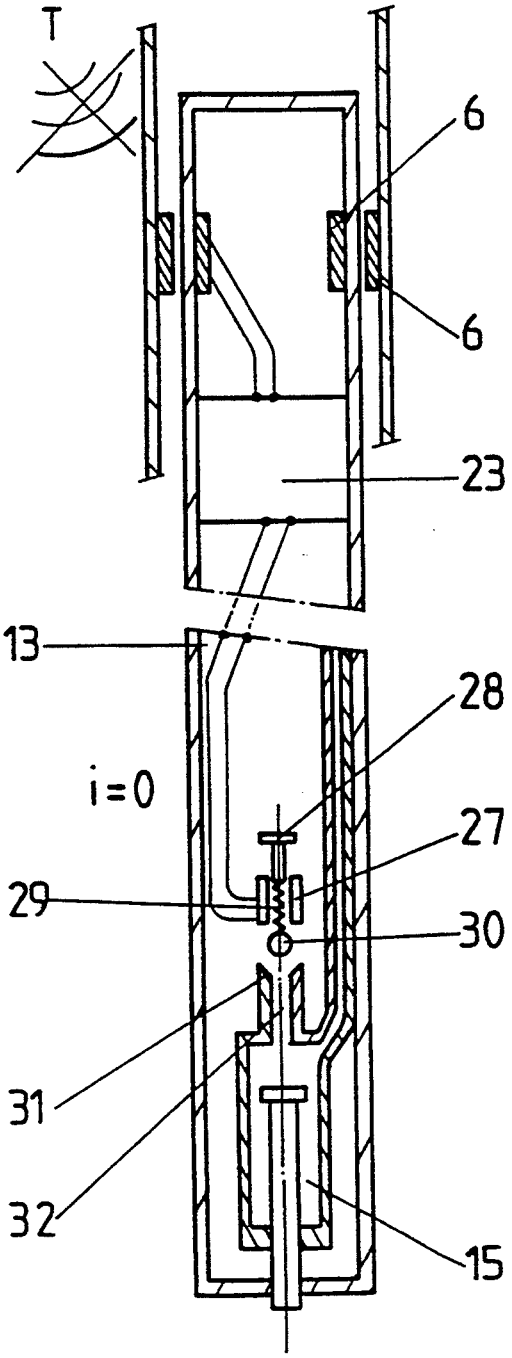
FIG. 3 is a view similar to FIG. 2 but corresponding to a closed position of the safety valve.

FIGS. 2 and 3 more particularly illustrate the elements involved in the operation of the control cartridge 1 according to the present invention in controlling the flapper valve 21. FIG. 2 shows the situation wherein the piston rod 16 is extended to open the flapper valve 21, and FIG. 3 shows the situation wherein the piston rod 16 is retracted to close the flapper valve 21.

As illustrated in FIG. 2, an electromagnetic wave train T causes a signal to be sent through the magnetic coupler 6 to the electronic control system 9. In FIGS. 2 and 3, a control card 23, as part of the electronic control system 9, is illustrated as connected to the magnetic coupler 6 through further cables or wires 7. The control card 23 is capable of reading a coded signal in the electromagnetic wave train T being transmitted thereto.

Two connection wires 24 and 25 extend from the control card 23 of the electronic control system 9 to an electromagnet 26. The electromagnet 26 has a solenoid 27 and a magnetic core 28. Further, a connection pipe 32 connects the high-pressure hydraulic fluid tank 15 to the low-pressure hydraulic fluid tank 13. The end of the connection pipe 32 forms a valve seat 31 providing a seat for a valve member 30. A spring 29 is acted on by the magnetic core 28 and engages the valve member 30 such that the spring tends to bias the valve member into engagement with the valve seat 31.

As still illustrated in FIG. 2, the magnetic core 28 can be activated by a current running through the solenoid 27 to act on the spring 29 and bias the valve member 30 into engagement with the valve seat 31 to close the connection pipe 32 in the open position of the flapper valve 21, i.e. with the piston rod 16 extended.

FIG. 3 corresponds substantially to FIG. 2, except that FIG. 3 illustrates the closed position of the flapper valve 21. When the control card 23 receives no control signal, as schematically illustrated in FIG. 3, no current is supplied to the solenoid 27. Thus, the magnetic core 28 is in the position as illustrated in FIG. 3 and allows the valve member 30 to permit the high-pressure hydraulic fluid in the tank 15 to escape through the connection pipe 32 into the low-pressure tank 13. Thus it can be seen that if there is a breakdown in the operation of the control cartridge 1, the magnetic core 28 would be automatically retracted and the high-pressure hydraulic fluid inside the tank 15 would be allowed to escape through the connection pipe 32, thus allowing the flapper valve 21 to move into the closed position. Thus a breakdown of the control cartridge 1 results in the automatic closing of the safety flapper valve 21.

Figure 4:
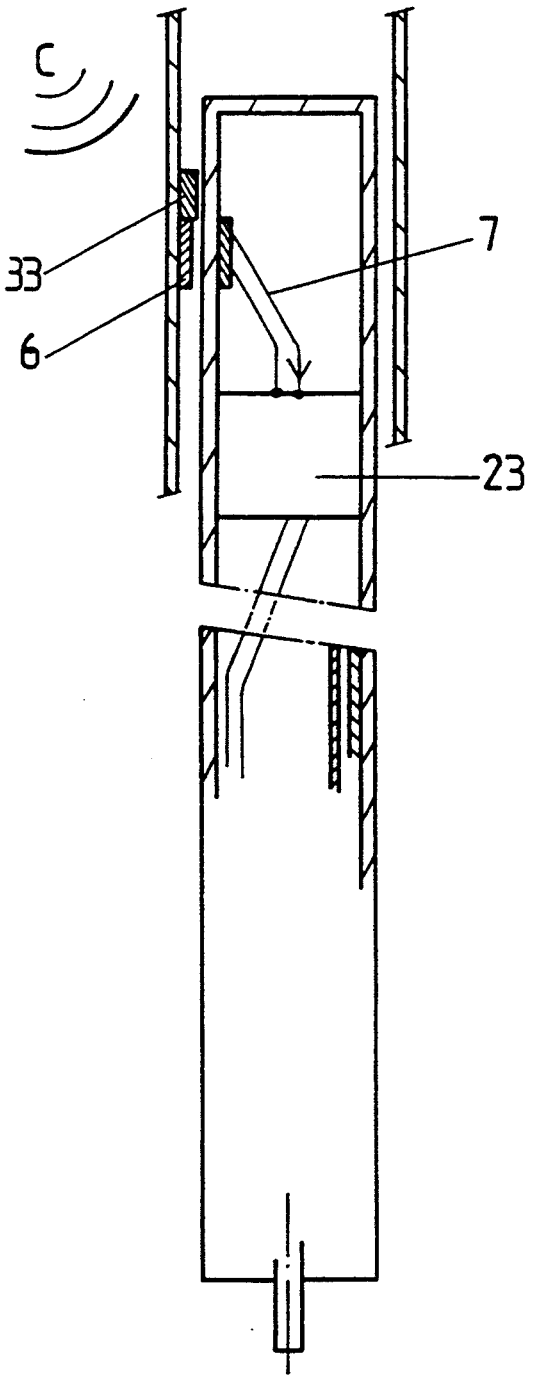
FIG. 4 is a schematic, cross-sectional view of the control cartridge according to the present invention illustrating the position of a pressure sensor on the tubing of the well.

FIG. 4 shows an alternate embodiment wherein the receiver includes a pressure sensor 33. The pressure sensor 33 is connected to the magnetic coupler 6, and is mounted on the inside of the tubing of the well. The pressure sensor 33 is designed so as to be capable of receiving acoustic signals transmitted through the fluid in the annular section of the well. Thus, acoustic signals C transmitted through the fluid in the annular section of the well will be received by the pressure sensor 33 on the tubing and transmitted by means of the magnetic coupler 6 to the control card 23 of the electronic control system 9. The acoustic signals may have frequencies between 1 and 30 Hz. Otherwise, the operation of the control cartridge 1 of FIG. 4, controlled by acoustic signals, is the same as the operation described with respect to FIGS. 2 and 3.

Figure 5:
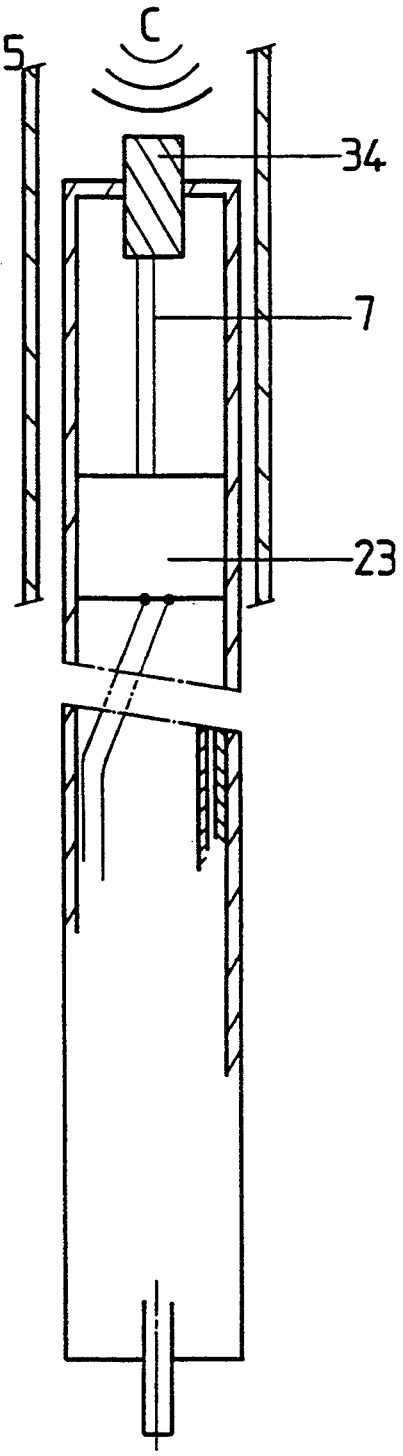
FIG. 5 is a view similar to FIG. 4 illustrating the position of a pressure sensor on the control cartridge.

FIG. 5 illustrates the mounting of a sensor 34 in the upper part of the control cartridge 1. The sensor 34 is similar to the pressure sensor 33 in that the sensor 34 is capable of receiving acoustic signals C. In this case, the acoustic signals are transmitted from the surface through the fluid contained in the well tubing. It is noted that in the case of FIG. 5, the use of a magnetic coupler 6 can be eliminated.

According to further features of the present invention, provided in order to refine the operation of the control cartridge 1, provision may be made so as to ensure that the position sensor 17 will stop the advance of the piston rod 16 once the valve 21 is completely open. Further, the position sensor 17 can also automatically compensate for leaks from the high-pressure tank 15. The electronic control system can establish a threshold amount of retraction allowable by the piston rod 16 while the piston rod 16 is in the open position of the valve 21 such that once the piston rod 16 goes beyond this threshold value, the hydraulic pump 12 is reactuated so as to reestablish the initial position of the piston rod 16.

Preferred embodiments of the present invention have been described and illustrated for purposes of explanation and not so as to limit the scope of protection of the present invention. Various modifications in the details of the present invention could be made to the preferred embodiments thereof, accordingly, while still remaining within the scope of the present invention. For example, the electronic control system illustrated and described could be used to control any device capable of motion when acted upon by hydraulic pressure. In particular, this system could be used for different types of valves.

I claim:

1. An operating well, having: well tubing;

a safety valve in said well tubing; and a control cartridge for controlling the safety valve, said control cartridge comprising:

a cartridge housing mounted in said well tubing;

a receiver for receiving transmitted control signals;

a power supply provided in said housing;

an electronic control system in said housing connected to both said receiver and said power supply;

a hydraulically operated actuator for controlling the safety valve; and a source of hydraulic fluid in said housing connected with said hydraulically operated actuator for operating said actuator, said source of hydraulic fluid being connected to said power supply.

2. The operation well of claim 1, wherein said actuator comprises a high-pressure hydraulic fluid tank having a piston rod extending therefrom to the exterior of said housing, said piston rod operably engaging said safety valve.

3. The operating well of claim 2, wherein said source of hydraulic fluid comprises a low-pressure hydraulic fluid tank defined in said housing, a hydraulic pump immersed in said low-pressure tank for receiving low-pressure hydraulic fluid therefrom and having a discharge pipe connecting said pump to said high-pressure hydraulic fluid tank, and a motor connected to said power supply and to said hydraulic pump for driving said hydraulic pump, wherein said high-pressure hydraulic fluid tank is also immersed in said low-pressure hydraulic fluid tank.

4. The operating well of claim 3, wherein said high-pressure hydraulic fluid tank has a fluid connection to said low-pressure fluid tank and an electronically controlled valve in said fluid connection controlled by said electronic control system.

5. The operating well of claim 4, wherein said fluid connection comprises a connection pipe having a free end that defines a valve seat, and said electronically controlled valve comprises a sealing member for sealing against said valve seat, a spring for biasing said sealing member against said valve seat and an electromagnet having a coil forming a solenoid and a ferromagnetic core rod engaging said spring for biasing said sealing member against said valve seat when said electromagnet is provided with a current.

6. The operating well of claim 5, wherein said electronic control system includes a control card capable of reading coded signals from said receiver and supplying current from said power supply to said electromagnet in response to said coded signals.

7. The operating well of claim 2, wherein said high-pressure hydraulic fluid tank has a fluid connection to a low-pressure fluid tank and an electronically controlled valve in said fluid connection controlled by said electronic control system.

8. The operating well of claim 7, wherein said fluid connection comprises a connection pipe having a free end that defines a valve seat, and said electronically controlled valve comprises a sealing member for sealing against said valve seat, a spring for biasing said sealing member against said valve seat and an electromagnet having a coil forming a solenoid and a ferromagnetic core rod engaging said spring for biasing said sealing member against said valve seat when said electromagnet is provided with a current.

9. The operating well of claim 8, wherein said electronic control system includes a control card capable of reading coded signals from said receiver and supplying current from said power supply to said electromagnet in response to said coded signals.

10. The operating well of claim 1, wherein said source of hydraulic fluid comprises a low-pressure hydraulic fluid tank defined in said housing, a hydraulic pump immersed in said low-pressure tank for receiving low-pressure hydraulic fluid therefrom and having a discharge pipe connecting said pump to said actuator, and a motor connected to said power supply and to said hydraulic pump for driving said hydraulic pump, and wherein said actuator is also immersed in said low-pressure hydraulic fluid tank.

11. The operating well of claim 1, wherein a position sensor is provided for sensing the position of said actuator, said position sensor being connected with said electronic control system, said position sensor and said electronic control system together defining a means for stopping advance of said actuator when said actuator has advanced to a predetermined position, and for automatically compensating for leaks of hydraulic fluid by causing said source of hydraulic fluid to supply hydraulic fluid to said actuator upon said actuator retracting beyond a threshold amount.

12. The operating well of claim 1, wherein said receiver comprises an antenna positioned inside said tubing and a magnetic coupler connected to both said antenna and to said electronic control system.

13. The operating well of claim 1, wherein said receiver is an electromagnetic signal receiver capable of receiving electromagnetic signals transmitted through the ground.

14. The operating well of claim 1, wherein said receiver includes a pressure sensor mounted on said tubing capable of receiving acoustic signals propagated through fluid in said tubing.

15. The operating well of claim 1, wherein said receiver includes a pressure sensor mounted on an upper portion of said housing capable of receiving acoustic signals propagated through fluid in said tubing.

16. A control cartridge for use in controlling a safety valve in an operating well, comprising:

a cartridge housing;

a receiver for receiving transmitted control signals;

a power supply provided in said housing;

an electronic control system in said housing connected to both said receiver and said power supply;

a hydraulically operated actuator for controlling the safety valve; and a source of hydraulic fluid in said housing connected with said hydraulically operated actuator for operating said actuator, said source of hydraulic fluid being connected to said power supply.

17. The control cartridge of claim 16, wherein said actuator comprises a high-pressure hydraulic fluid tank having a piston rod extending therefrom to the exterior of said housing for operably engaging the safety valve.

18. The control cartridge of claim 17, wherein said source of hydraulic fluid comprises a low-pressure hydraulic fluid tank defined in said housing, a hydraulic pump immersed in said low-pressure tank for receiving low-pressure hydraulic fluid therefrom and having a discharge pipe connecting said pump to said high-pressure hydraulic fluid tank, and a motor connected to said power supply and to said hydraulic pump for driving said hydraulic pump, wherein said high-pressure hydraulic fluid tank is also immersed in said low-pressure hydraulic fluid tank.

19. The control cartridge of claim 18, wherein said high-pressure hydraulic fluid tank has a fluid connection to said low-pressure fluid tank and an electronically controlled valve in said fluid connection controlled by said electronic control system.

20. The control cartridge of claim 19, wherein said fluid connection comprises a connection pipe having a free end that defines a valve seat, and said electronically controlled valve comprises a sealing member for sealing against said valve seat, a spring for biasing said sealing member against said valve seat and an electromagnet having a coil forming a solenoid and a ferromagnetic core rod engaging said spring for biasing said sealing member against said valve seat when said electromagnet is provided with a current.

21. The control cartridge of claim 20, wherein said electronic control system includes a control card capable of reading coded signals from said receiver and supplying current from said power supply to said electromagnet in response to said coded signals.

22. The control cartridge of claim 17, wherein said high-pressure hydraulic fluid tank has a fluid connection to a low-pressure fluid tank and an electronically controlled valve in said fluid connection controlled by said electronic control system.

23. The control cartridge of claim 22, wherein said fluid connection comprises a connection pipe having a free end that defines a valve seat, and said electronically controlled valve comprises a sealing member for sealing against said valve seat, a spring for biasing said sealing member against said valve seat and an electromagnet having a coil forming a solenoid and a ferromagnetic core rod engaging said spring for biasing said sealing member against said valve seat when said electromagnet is provided with a current.

24. The control cartridge of claim 23, wherein said electronic control system includes a control card capable of reading coded signals from said receiver and supplying current from said power supply to said electromagnet in response to said coded signals.

25. The control cartridge of claim 16, wherein said source of hydraulic fluid comprises a low-pressure hydraulic fluid tank defined in said housing, a hydraulic pump immersed in said low-pressure tank for receiving low-pressure hydraulic fluid therefrom and having a discharge pipe connecting said pump to said actuator, and a motor connected to said power supply and to said hydraulic pump for driving said hydraulic pump, and wherein said actuator is also immersed in said low-pressure hydraulic fluid tank.

26. The control cartridge of claim 16, wherein a position sensor is provided for sensing the position of said actuator, said position sensor being connected with said electronic control system, said position sensor and said electronic control system together defining a means for stopping advance of said actuator when said actuator has advanced to a predetermined position, and for automatically compensating for leaks of hydraulic fluid by causing said source of hydraulic fluid to supply hydraulic fluid to said actuator upon said actuator retracting beyond a threshold amount.

27. The control cartridge of claim 16, wherein said receiver comprises an antenna and a magnetic coupler connected to both said antenna and to said electronic control system.

28. The control cartridge of claim 16, wherein said receiver is an electromagnetic signal receiver capable of receiving electromagnetic signals transmitted through the ground.

29. The control cartridge of claim 16, wherein said receiver includes a pressure sensor capable of receiving acoustic signals propagated through fluid.

30. The control cartridge of claim 16, wherein said receiver includes a pressure sensor mounted on an upper portion of said housing capable of receiving acoustic signals propagated through fluid.

* * * * *